United States Patent [19]

Sikka

[11] Patent Number: 4,612,070

[45] Date of Patent: Sep. 16, 1986

[54] METHOD FOR WELDING CHROMIUM MOLYBDENUM STEELS

[75] Inventor: Vinod K. Sikka, Clinton, Tenn.

[73] Assignee: The United States of America as represented by the United States Department of Energy, Washington, D.C.

[21] Appl. No.: 795,605

[22] Filed: Nov. 6, 1985

[51] Int. Cl.[4] ..... C21D 9/50

[52] U.S. Cl. ..... 148/127

[58] Field of Search ..... 148/127, 134, 135, 136

[56] References Cited

U.S. PATENT DOCUMENTS 4,402,769 9/1983 Beigay et al. ..... 148/127

*Primary Examiner*—R. Dean

*Attorney, Agent, or Firm*—Katherine P. Lovingood; Stephen D. Hamel; Judson R. Hightower

[57] ABSTRACT

Chromium-molybdenum steels exhibit a weakening after welding in an area adjacent to the weld. This invention is an improved method for welding to eliminate the weakness by subjecting normalized steel to a partial temper prior to welding and subsequently fully tempering the welded article for optimum strength and ductility.

2 Claims, 5 Drawing Figures

METHOD FOR WELDING CHROMIUM MOLYBDENUM STEELS

BACKGROUND OF THE INVENTION

This invention is a method for welding chromium-molybdenum steels while avoiding a weakening in the steel in an area adjacent to the weld and was developed pursuant to a contract with the U.S. Department of Energy.

Chromium alloy steels are valued for their strength and ductility in high temperature, high pressure and corrosive environments. Because of these properties they are used extensively as critical components of both coal-fired and nuclear-power generating facilities. A modified 9 chromium-1 molybdenum wt. % (9 Cr-1 Mo) ferritic steel that exhibits superior characteristics for these applications is characterized by having small amounts of niobium, vanadium and silicon as well as carbon and nitrogen.

As is the case with all structural materials, it is necessary to join individual components of metals in order to form an assembled structure. There are a number of ways to join component parts and welding is a standard means for joining steels of this type. 9 Cr-1 Mo steels are normalized at 1040° C. and tempered at 760° C. for optimum strength and ductility; however, when they are subsequently welded they exhibit softness in the heat affected zone near the interface between the weld filler metal and the base metal. The chromium-molybdenum steels 2¼ Cr-1 Mo and German made 12 Cr-1 Mo with 0.2 wt. % carbon were also tested and both develop softened area adjacent to the weld. It is, therefore, concluded that the problem of softening is common to chromium-molybdenum (Cr-Mo) steels in general. Other examples of Cr-Mo steels are Japanese manufactured 9 Cr-2 Mo and French manufactured 9 Cr-2 Mo with vanadium and niobium. It has been determined that the lack of hardness in these steels in the heat affected zone is caused by an overtemper of the base metal and is related to standard normalizing and tempering procedures at 1040° C. and 760° C. respectively. It is therefore necessary to determine a method by which Cr-Mo steels can be joined by welding without development of structural weaknesses adjacent to the weld while maintaining optimum strength and ductility in the base metal.

SUMMARY OF THE INVENTION

In view of the above it is an object of this invention is to provide a strong and ductile assembled structure that is made by welding Cr-Mo steels to themselves and other components.

It is also an object of this invention to provide a method for welding Cr-Mo steels without a resulting softness in the heat affected zone.

Other objects of the invention will become apparent to those skilled in the art upon study of the specifications and the claims.

In order to achieve the foregoing and other objects, this invention is a process of welding Cr-Mo steels by first normalizing the steel, next partially tempering the steel, next welding the steel and finally fully tempering the steel. In the preferred embodiment the steel is first normalized by heat treating above its transformation range and subsequently air cooled to refine grain structure. After normalizing, the steel is heat treated at a temperature less than a full temper. After the first temper the steel component is welded using an appropriate filler metal. After welding, the joint is fully tempered at a temperature suitable to reduce stress, increase ductility and toughness andlessen hardness.

The advantage of using this technique is to avoid a softening in the heat affected zone by performing a partial temper after normalization and prior to welding and then after welding performing a full temper which eliminates the overtempering of the base metal in the area of the weld.

DETAILED DESCRIPTION OF THE PREFERRED EMBODIMENT

In welding 9 Cr-1 Mo steels it was discovered that a softened area developed in the heat affected zone of the steel base metal near the interface of the weld filler metal and the base metal resulting in a weakness in the weld assembled structure. The solution to this problem is partially tempering, instead of fully tempering, the steel after normalization and prior to welding. After the welding the steel can then be fully tempered for maximum toughness.

Figure 1:
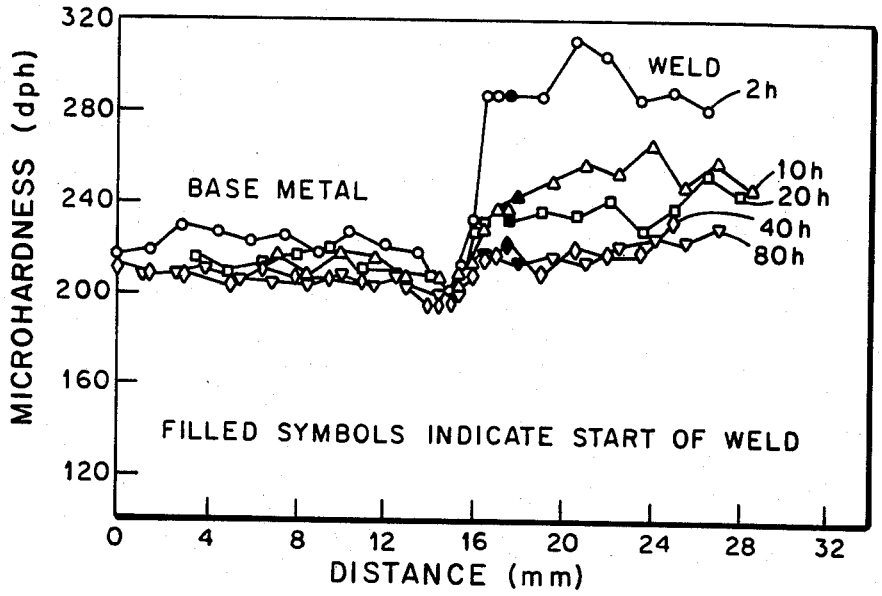
FIG. 1 is hardness traverse data for submerged arc welds in modified 9 Cr-1 Mo steel that was normalized at 1040° C. and tempered at 760° C. illustrating the hardness dip at the interface between the weld metal and the base metal after post weld tempering at 732° C.
Figure 2:
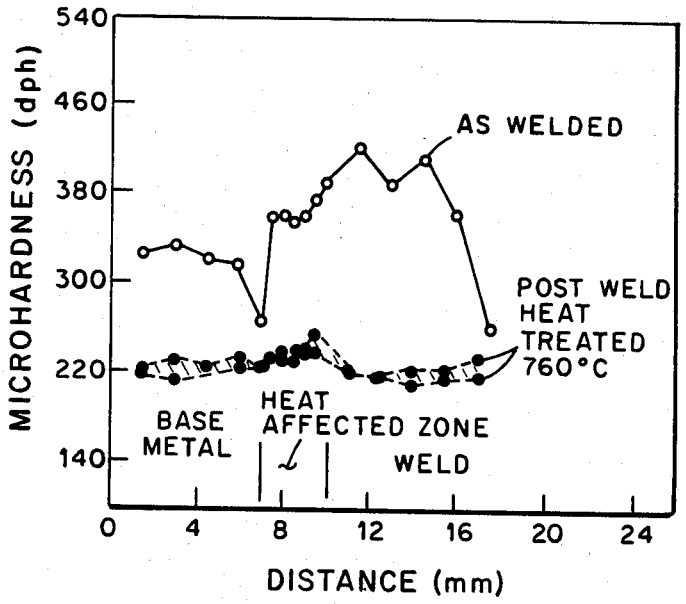
FIG. 2 illustrates hardness traverse data for submerged arc welds in modified 9 Cr-1 Mo steel that was normalized at 1040° C. and tempered at 621° C. and shows that reducing the base plate tempering temperature to 621° C. results in uniform hardness in the assembled structure after a post weld tempering at 760° C. Two lines represent two hardness tests performed on the same weld.

The overtempered region is identified and located by weldment hardness traverses and is exemplified by a hardness dip in the heat affected zone near the interface between the weld metal and the base metal as shown in FIG. 1. This zone is believed to originate from heating too near the lower transformation temperature of the base material during welding. If this is the origin, it is postulated that if normalized plate were tempered before welding at a temperature below 760° C., with a post weld temper at the standard 760° C. to optimize strength and ductility, overtempering could be reduced or avoided. To test this hypothesis weldments were made from a plate that had been normalized at 1040° C. and tempered at 600° to 650° C. Initial results shown in FIG. 2 indicate that for post weld heat treatment at 760° C., preweld tempering at 621° C. produced the desired effect.

Cr-Mo steels in general and the modified 9 Cr-1 Mo alloy in particular are of interest for several potential applications including coal-fired and nuclear-powered generating facilities as well as in certain coal gasification and fusion energy applications. It is essential for these steels to be able to undergo a weld that will result in a strong stable joint while maintaining optimum strength and ductility for them to be useful. This invention accomplishes the desired welding that will allow the steels to be of extensive use in industry. The preferred procedure is described as follows.

In manufacture of quench-and-tempered structural alloys having a nominal composition of 9 Cr-1 Mo and the balance iron, the practice in the industry is to cast and roll the alloy into a sheet of selected thickness, give it a normalization heat treatment at 1040° C. followed by tempering heat treatment at 760° C. for optimum strength and ductility. To achieve a welded structure free of softening in the heat affected zone of the base metal, the steel is first subjected to a partial temper heat treatment, rather than a full temper heat treatment, after the initial industrial normalization. If a full heat treatment is done instead of a partial heat treatment, it is necessary to repeat the normalization procedure and partially heat treat the steel again before welding. The steel is then welded to the weld metal and, after welding, the steel and weld metal are subjected to a full temper resulting in a heat affected zone that is not overtempered. For a metal sheet having a thickness of 1 inch, the preferred partial temper is at 621° C. for a period of one hour. The metal is then welded, and after the weld a full temper condition is achieved by a post weld heat treatment at 760° C. for one hour. This procedure yields a material in a fully tempered state that does not exhibit the usual softness resulting from overtempering in the heat affected zone.

Figure 3:
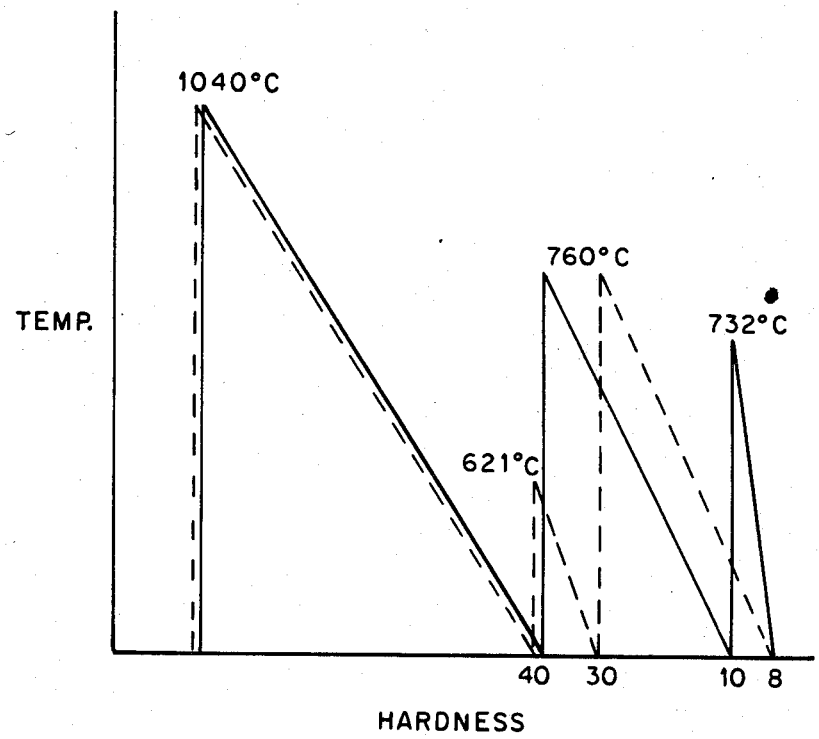
FIG. 3 illustrates the normalization and tempering processes in terms of temperature and time for the conventional process and the process of this invention.

The reason that the invention is successful can be explained by reference to FIGS. 3, 4, and 5 (the hardness expressed is theoretical yet representative and is intended to be illustrative). In FIG. 3, the alloy is heated to a temperature of 1040° C. the standard normalization temperature, and all components are in solution. The alloy is then allowed to cool resulting in a very hard, brittle metal, 40 indicating a hard condition as opposed to 8 indicating a soft condition. To soften this metal so that it is not subject to cracking and breaking, the metal is tempered, in other words, heated to a temperature below its transition temperature and again cooled resulting in a tempered, or softened metal. FIG. 3 illustrates the degree of softening in a metal having a initial hardness of 40 using the conventional method (solid line) and using the method of this invention (dashed line). Tempering at 760° C. results in a softer preweld condition of 10 than tempering at 621° C. which gives a preweld hardness of 30.

Figure 4:
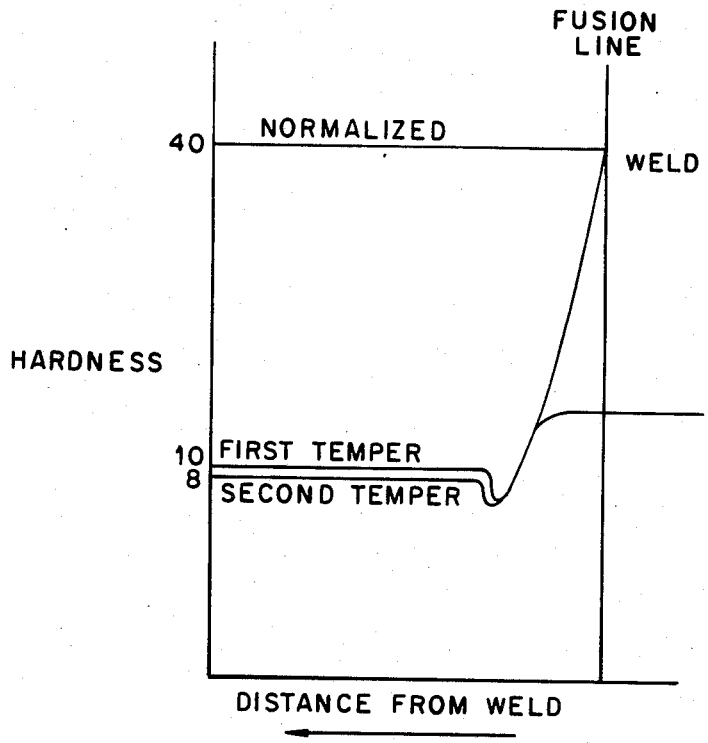
FIG. 4 illustrates hardness of the metal after preweld temper and after post weld temper using the conventional process.
Figure 5:
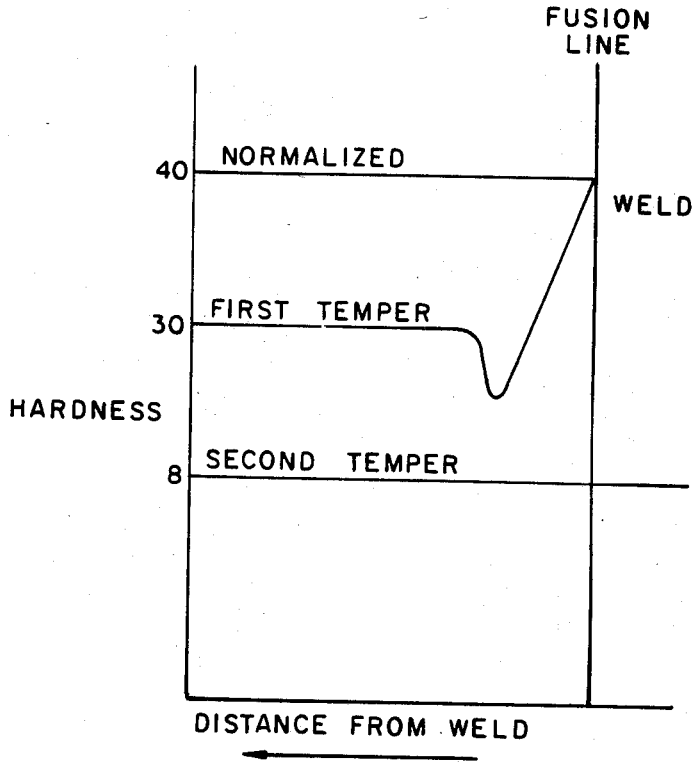
FIG. 5 illustrates hardness of the metal after preweld temper and after post weld temper using the process of this invention.

In FIGS. 4 and 5 the post weld hardness of the metal and weld after the second temper is shown when the preweld hardness of the metal after the first temper is 10 and 30 respectively. When metal is welded, the metal adjacent to the weld experiences extremely hot temperatures from the heat of the welding procedure, again in the range experienced during the normalization process, with varying temperature ranges decreasing with an increasing distance from the weld so that at a certain distance from the weld the metal is again experiencing tempering, or softening, conditions. As this cools there is again a transformation of the metal as was the case in the initial normalization and tempering procedures with hardness being most severe adjacent to the weld causing a brittleness that must again be removed by the second temper. For the metal undergoing a first temper at 760° C. as shown in FIG. 4, a softened area remains after the second temper since the second temper is not hot enough to soften the entire assembly to the softness of the overtempered area. The metal could be tempered at a higher temperature, however, strength would be sacrificed to excessive ductility throughout the assembled structure.

The solution to the problem is to temper, after normalization, at a lower temper than a full temper thereby resulting in a harder base metal before welding as shown in FIG. 5. When this harder base metal is welded there is a softening of the metal adjacent to the weld in the heat affected zone; however, since the base metal is harder to begin with, the metal adjacent to the weld is not as soft as it would have been had the base metal been softer before of the weld. After the metal is welded, the metal and the weld are tempered at a temperature higher than that of the first partial temper and then allowed to cool resulting in a metal of uniform hardness showing no softening in the heat affected zone.

Discovery of the cause of weakness in welded assemblies having a Cr-Mo steel component and the resulting solution is a significant advance in the use of these steels in high temperature, high pressure and corrosive environments such as coal-fired and nuclear-power generating facilities.

I claim:

1. A process for welding chromium-molybdenum steels comprising:

subjecting said steel to normalization by heating to above the transformation temperature and cooling in air;

subjecting said steel to a partial temper by heating to a temperature less than a full temper;

welding said steel using an appropriate filler metal;

subjecting said steel to a full temper by heating to a temperature sufficient to optimize strength, reduce stress, increase ductility and reduce hardness.

2. The process of claim 1 wherein said steel comprises 9 chromium-1 molybdenum wt. % and the balance iron, said normalization is at a temperature above about 1040° C., said partial temper is a temperature of about 620° C. and said full temper is at a temperature of about 760° C.

* * * * *